US011478694B2

(12) United States Patent
Forgrave et al.

(10) Patent No.: US 11,478,694 B2
(45) Date of Patent: Oct. 25, 2022

(54) MODULAR MARBLE TOY KIT

(71) Applicant: Global Family Brands, LLC, Indianapolis, IN (US)

(72) Inventors: Jeffrey David Forgrave, Indianapolis, IN (US); Chong Piu Wong, Kowloon Bay (HK)

(73) Assignee: Pike Brands, LLC, Seattle, WA (US)

( * ) Notice: Subject to any disclaimer, the term of this patent is extended or adjusted under 35 U.S.C. 154(b) by 577 days.

(21) Appl. No.: 16/028,116

(22) Filed: Jul. 5, 2018

(65) Prior Publication Data

US 2019/0038963 A1 Feb. 7, 2019

Related U.S. Application Data

(60) Provisional application No. 62/539,986, filed on Aug. 1, 2017.

(51) Int. Cl.
*A63F 7/36* (2006.01)
*A63H 33/08* (2006.01)

(52) U.S. Cl.
CPC ..... *A63F 7/3622* (2013.01); *A63H 33/08* (2013.01); *A63F 2007/3662* (2013.01)

(58) Field of Classification Search
CPC ..... A63F 7/3622; A63F 2007/3662; A63H 33/08; A63H 33/04
USPC ..... 446/85
See application file for complete search history.

(56) References Cited

U.S. PATENT DOCUMENTS 3,343,793 A * 9/1967 Waser ..... A63F 7/3622 238/1 OR
4,861,036 A * 8/1989 Watanabe ..... A63F 7/042 273/109
5,312,285 A * 5/1994 Rieber ..... A63F 7/3622 273/109

(Continued)

FOREIGN PATENT DOCUMENTS

WO WO-9426372 A1 * 11/1994 ..... A63F 7/3622

OTHER PUBLICATIONS

Gravity Maze ( https://www.youtube.com/watch?v=eviTlcChmaQ) entire video, screenshot captures provide in NPL document dated Apr. 5, 2019 by applicant, 2014.*

(Continued)

*Primary Examiner* — John E Simms, Jr.
*Assistant Examiner* — Rayshun K Peng
(74) *Attorney, Agent, or Firm* — Maginot, Moore & Beck LLP

(57) ABSTRACT

A marble toy kit includes building blocks and base platforms. Each building block includes a block base, formed of a single piece of plastic, that has four sides interconnected to form a tubular member having a square cross-section and having an interior. At least one side has an opening sized to receive a toy marble. The top of each building block has a base portion and a connection boss extending from the base portion. The connection boss and base portion have a second opening sized to receive a toy marble. The boss is configured to engage and fit within the open bottom of another block base having the same structure. At least one base platform includes a plurality of pedestals extending from a top surface. Each pedestal fits within the open-bottom of the block base of a building block to attach the block base to the base platform.

14 Claims, 12 Drawing Sheets

(56) References Cited

U.S. PATENT DOCUMENTS

| | | | | |
|---|---|---|---|---|
| 5,344,143 | A * | 9/1994 | Yule | A63F 7/3622 273/118 R |
| 6,273,778 | B1 * | 8/2001 | Kyster | A63H 33/042 446/85 |
| 2014/0252718 | A1 * | 9/2014 | Rieman | A63B 67/002 273/342 |

OTHER PUBLICATIONS https://www.thinkfun.com/wp-content/uploads/2014/09/Gravi-1006-Instructions.pdf. Copyright ©2019 ThinkFun, Inc.†
Amazon.com. Gravity Maze—ThinkFun. Retrieved Apr. 1, 2019.†
ThinkFun. How to Play: Gravity Maze. 6 pages. Published Jul. 10, 2014. YouTube.†

* cited by examiner
† cited by third party

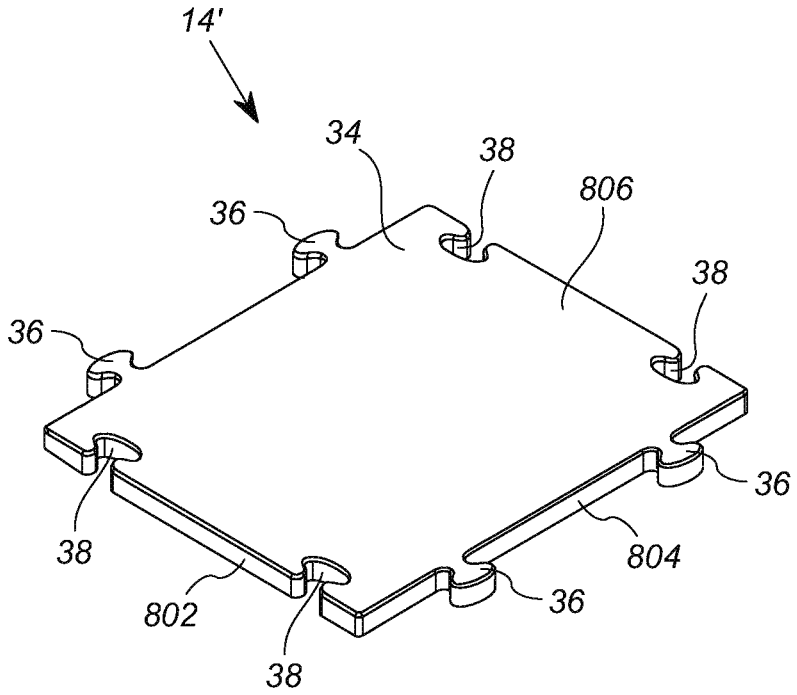
FIG. 12
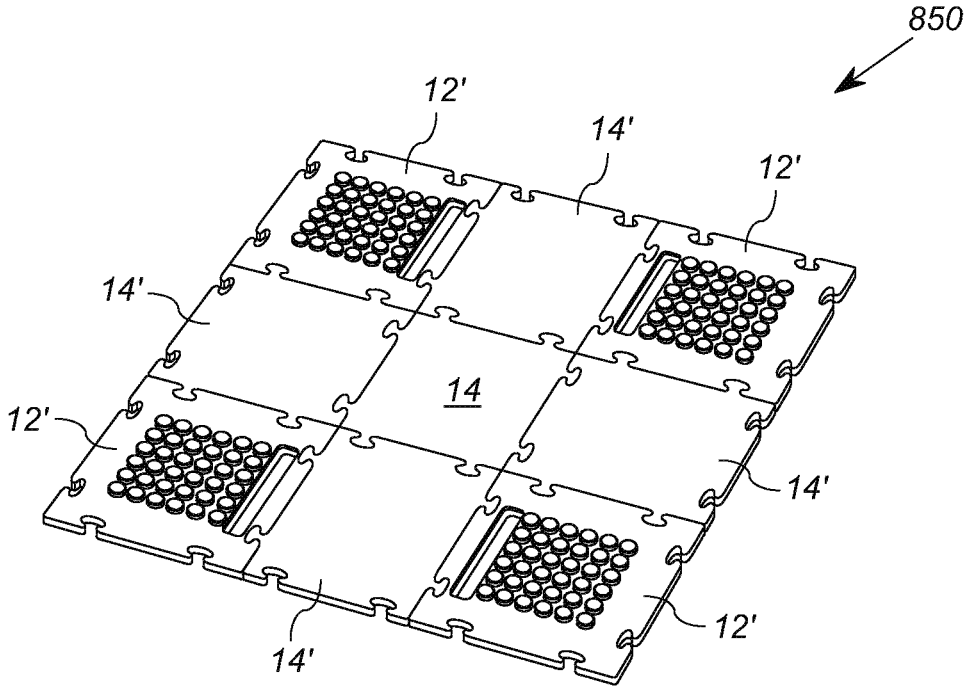
FGI.13

MODULAR MARBLE TOY KIT

This application claims the benefit of U.S. Provisional Application Ser. No. 62/539,986, filed Aug. 1, 2017.

FIELD OF INVENTION

The present invention relates to modular marble toys.

BACKGROUND

Marble games have been popular among consumers for decades. Marble mazes and marble races in particular are two common types of marble games wherein the user assembles a plurality of pieces to create a track through which marbles travel from a starting position to an ending position. Marble games typically utilize gravity to propel the marble along the desired path.

Generally, in a marble race game, the user must assemble a track using multiple different elements wherein the marble travels down sloped paths between towers built by the user. Marble race games typically focus on exposed portions of track wherein the user can view the marble as it travels along the constructed path. At the end of each piece, the marble typically falls a short vertical distance to the next section of track. Enjoyment can be gleaned from this game as the user sends marbles down the track of his or her creation, with tracks often utilizing special pieces such as spirals, pinwheels, and jumps. These games can be built to be cover significant area, or designed by the user to travel through obstacles in the area of play. Such a system is disclosed by Wichman in U.S. Pat. No. 4,713,038 and Klitsner in U.S. Pat. No. 4,874,342.

Marble maze games are typically more vertically disposed, with the user creating a tightly winding path through which the marble is meant to travel. Typically, these games have an objective, such as building an apparatus that will sort marbles of varying colors or sizes into specific groups.

Another objective of marble maze games may be to build a path for a marble to travel from a specified starting position to a specified ending position using a set of specified pieces. Such a game is available from ThinkFun, Inc., entitled "Gravity Maze", in which a user attempts to complete a path between specified points using specified pieces. In this game, plastic column pieces are supplied, and the tracks contained within a column are configured in predetermined orientations leading to a limited number of possible track combinations and configurations. Additionally, the heights of the columns are fixed, and are not designed to be stackable.

Both the above described systems offer their own style of amusement, but limited interactivity with other play objects, such as toy vehicles, toy people and the like. User defined marble mazes are typically abstract in nature, and thus utilize imagination in certain ways, but not others. Therefore, a need exists for a modular marble toy kit that incorporates the some of the aspects of marble mazes while providing the ability to simulate building structures, thereby facilitating interplay with other toys.

SUMMARY OF THE INVENTION

Embodiments of the present invention address the above stated need by providing marble toy kit that includes modular, connectible blocks that have different marble paths therethrough, and base platforms for securing the stacks of blocks in user-selected patterns.

A first embodiment is a marble toy kit that includes a plurality of building blocks and a plurality of base platforms. Each building block includes a block base that has four sides interconnected to form a tubular member having an external perimeter defining a square cross-section and having an interior. At least a first side has an opening sized to receive a toy marble therethrough. The top of each building block engages each of the four sides, and has a base portion and a connection boss extending from the base portion. The connection boss and base portion have a second opening sized to receive a toy marble therethrough. The boss is configured to engage and fit within the open bottom of another block base having the same structure. The block based is formed of a single piece of plastic. A first base platform includes a top surface and a plurality of pedestals extending from the top surface. Each pedestal fits within the open-bottom of the block base of a building block to attach the block base to the base platform.

The above described features and advantages, as well as others, will become more readily apparent to those of ordinary skill in the art by reference to the following detailed description and accompanying drawings.

BRIEF DESCRIPTION OF THE DRAWINGS

FIG. 12 illustrates a perspective view of another exemplary base platform without pedestals that may be included in or used in connection with the kit of FIG. 1;

FIG. 13 shows a perspective view of an exemplary arrangement of interconnected base platforms of FIGS. 9B and 11;

DETAILED DESCRIPTION

Figure 1:
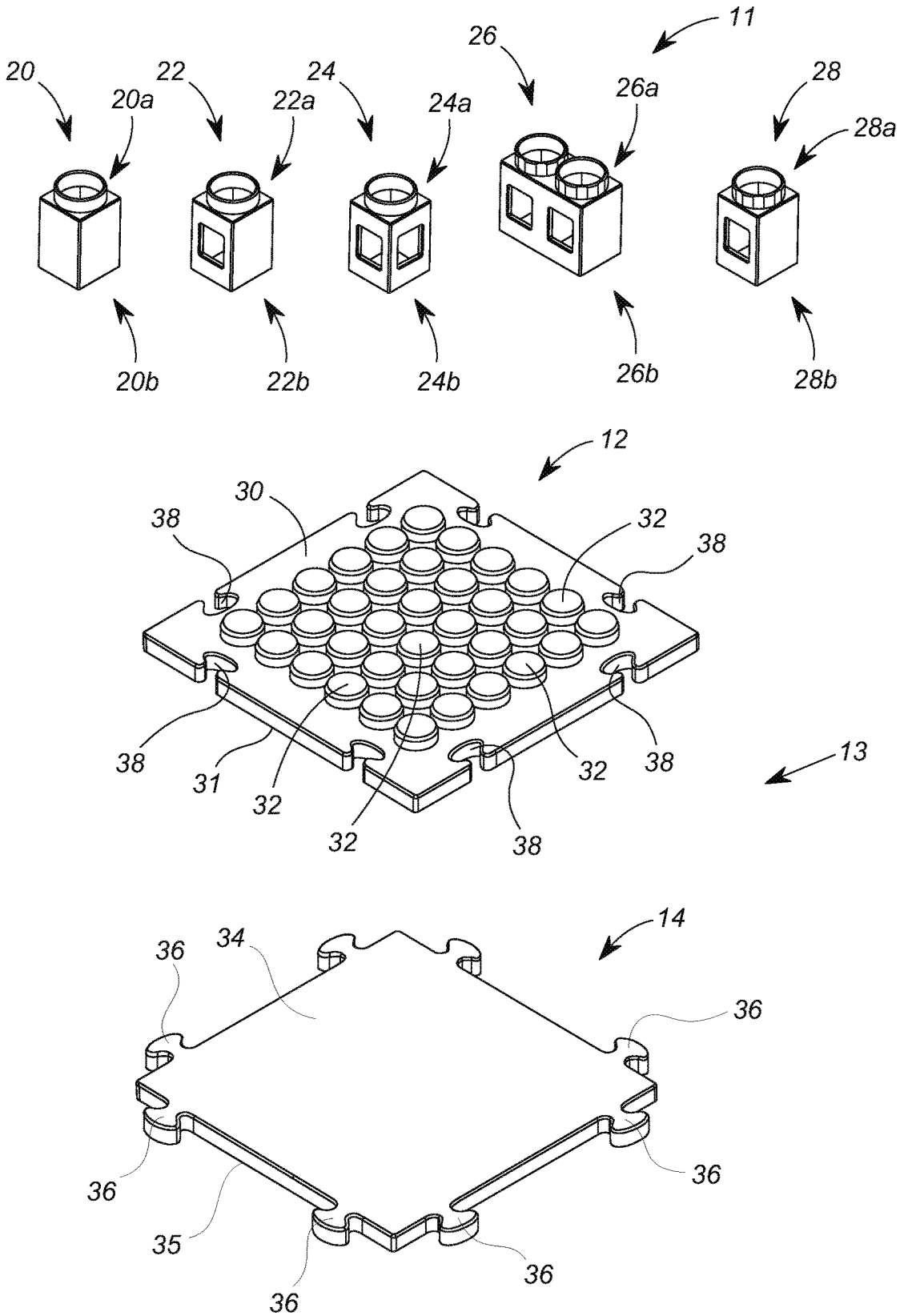
FIG. 1 shows a perspective view of an exemplary kit according to the present disclosure.

FIG. 1 shows a top plan view of a modular marble maze kit 10 according to an exemplary embodiment of the invention. The kit 10 includes a plurality of hollow stackable blocks 11 and a plurality of base platforms 13. In this embodiment, the plurality of hollow stackable blocks 11 includes exemplary stackable blocks 20, 22, 24, 26 and 28, as well as sets of multiple blocks having a substantially similar construction. In other words, the plurality of hollow stackable blocks includes multiple blocks having the design of block 20, multiple blocks having the design of block 22, multiple blocks having the design 24, and so forth. The plurality of base platforms 13 includes exemplary base platforms 12 and 14, as well as sets of multiple base platforms having similar designs, as will be discussed below.

Each stackable block 20, 22, 24, 26 and 28 has a corresponding top 20*a*, 22*a*, 24*a*, 26*a* and 28*a*, and a corresponding bottom 20*b*, 22*b*, 24*b*, 26*b* and 28*b*. Each top 20*a*, 22*a*, 24*a*, 26*a* and 28*a* is configured to engage and attach to a bottom 20*b*, 22*b*, 24*b*, 26*b* and 28*b* of another stackable block. For example, the top 22*a* of the stackable block 22 is configured to engage and attach to the bottom 20*b* of the stackable block 20, as well as to the bottom 24*b* of the stackable block 24, the bottom 26*b* of stackable block 26, and the bottom 28*b* of the stackable block 28.

As will be discussed further below in detail, each of the stackable blocks 20, 22, 24, 26 and 28 has at two openings and an interior, both sufficiently sized so as to facilitate the passage of a marble, not shown. By way of example, the openings are preferably designed to have at least approximately 9 mm radial clearance, regardless of shape. As will also be discussed below in connection with FIGS. 2A-2C, 3, 4A-4C, 6A-6C and 7A-7B, each of the stackable blocks 20, 22, 24, 26 and 28 has first, second, third and fourth sides interconnected to form a tubular member having an external perimeter defining a rectangular cross-section (square cross-section in the case of blocks 20, 22, 24 and 28), and having an interior. Each of the stackable blocks 22, 24, 26 and 28 has at least a first side having a first opening sized to receive a toy marble therethrough.

The plurality of stackable blocks 11 may be stacked and combined by a user in a myriad of ways to form elongated and serpentine marble passages or paths. The plurality of stackable blocks 11 may include other blocks without openings, or with a single opening, not shown, which have tops and/or bottoms configured to connect to each other, and to connect to the tops or bottoms of the stackable blocks 20, 22, 24, 26 and 28.

Each of the plurality of base platforms 13 is configured to interlock with another of the plurality of base platforms 13. In this embodiment, the base platform 12 has a top surface 30, a bottom surface 31, and a plurality of pedestals 32 disposed on and extending from the top surface 30. Each pedestal 32 is sized and configured to fit within the bottom 20*b*, 22*b*, 24*b*, 26*b* and 28*b* of corresponding blocks 20, 22, 24, 26 and 28, so as to engage and removably secure the blocks 20, 22, 24, 26 and 28 to the corresponding base platform 12.

In this embodiment, the base platform 14 has a top surface 34 that does not have pedestals, and a bottom surface 35. In general, the plurality of base platforms 13 are configured to engage with each other such that the top surfaces 30 and 34 are at least in parallel planes, and preferably are coplanar. Thus, for example, the bottom surfaces 31 and 35 may suitably be coplanar as well. As such the base platforms 12 and 14 may be combined to have first portions (base platform 12 and similar base platforms) on which structures of combinations of blocks 11 may be built and secured, and second portions (base platform 14 and similar base platforms) that form play surfaces for toy vehicles, toy people, and the like, not shown.

The plurality of base platforms 13 interconnect with each other via sets of plugs 36 and corresponding receptacles 38. FIG. 13, by way of example, shows various the plurality of base platforms interconnected in a pattern. Referring again to FIG. 1, the base platform 12 has two receptacles 38 on each of its edges and the base platform 14 has two plugs 36 on each of its edges. In general, the receptacles 38 are sized and configured to receive the plugs 36 to connect the base platforms 12 and 14 like jigsaw puzzle pieces. The plurality of base platforms 13 preferably includes other platforms, discussed further below, both with and without pedestals and having different combinations of plugs 36 and receptacles 38 to allow different configurations.

Figure 2B:
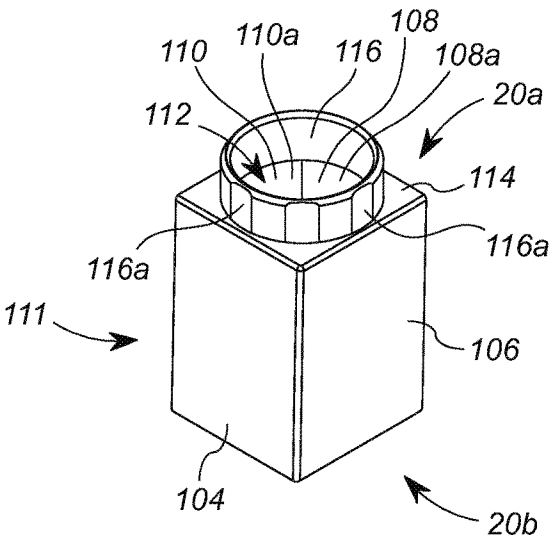
FIG. 2B illustrates a perspective view of the building block of FIG. 2A.
Figure 2C:
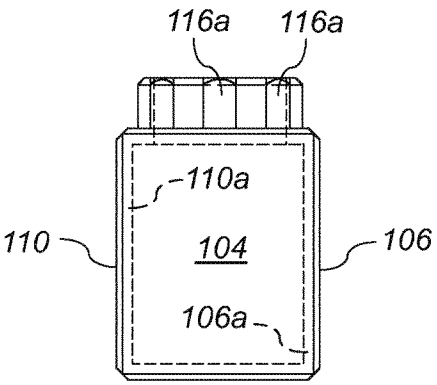
FIG. 2C illustrated a side plan view of the building block of FIG. 2A.
Figure 2A:
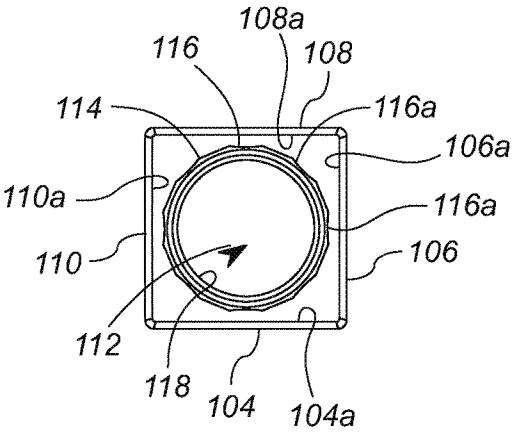
FIG. 2A illustrates a top plan view of an exemplary building block that may be included in or used in connection with the kit of FIG. 1.

FIGS. 2A-2C show a preferred embodiment of the first block 20 of FIG. 1. FIG. 2A shows a top plan view of the block 20, FIG. 2B shows a perspective view of the block 20, and FIG. 2C shows a side plan view of the block 20.

In addition to the top 20*a* and bottom 20*b*, the block 20 in this embodiment has first, second, third and fourth sides 104, 106, 108 and 110, respectively, that interconnected to form a tubular member 111 having an external perimeter defining a square cross-section and having an interior 112. The top 20*a* has a base portion 114 that engages each of the first, second, third and fourth sides 104, 106, 108 and 110, respectively, and a connection boss 116 extending upward from the base portion 114. The base portion 114 and connection boss 116 define a central opening 118 sized to receive a toy marble therethrough.

The base portion 114 of the top 20*a* is also configured to engage the bottom edges of at least two sides of a similar bottom structure (e.g. bottoms 20*b*, 22*b*, 24*b* etc.) in a second block. In this embodiment, the base portion 114 is a flat horizontal plate having an outer perimeter that is equal to that of the perimeter of the tubular member 111.

The first, second, third and fourth sides 104, 106, 108 and 110, respectively, terminate at the bottom 20*b* to form an open bottom. As a result, the opening 118, the tubular member 111 and the open bottom 20*b* define a marble passage through that block 20. The boss 116 is configured to engage and fit within the first, second, third and fourth sides (e.g. 104, 106, 108 and 110) of a second block, not shown in FIG. 2, which has the same bottom structure as the block 20, for example, any of the bottoms 22*b*, 24*b*, or 28*b* of FIG. 1.

The connection boss 116 thus has an outer diameter or outer perimeter that is sized to fit within and engage at least two sides of the other block (e.g. any of sides 104, 106, 108 or 110 of another block 20). In this embodiment, the connection boss 116 is in the form of a generally round ring having chords 116*a* or other discontinuities on the outer perimeter. The distance between opposing chords 116*a* should be substantially the same as the dimension between inner surfaces 104*a*, 106*a*, 108*a* and 110*a* of opposing sides 104/108 and/or 106/110. Thus, the chords 116*a* can engage the corresponding inner surfaces of another block. The connection boss 116 may take other shapes, such as a ring shape without chords 116*a*, or with fewer chords. However, the cords add a feature of assisting in the alignment of the blocks 20, 22, 24, 26 and 28 when they are connected and stacked, because the flat surfaces of the chords 116*a* seat against the inner surfaces of the other block's sides in a predetermined rotational relationship. In this embodiment, the surfaces of four of the chords 116*a* lie in planes that are parallel to the inner surfaces 104*a*, 106*a*, 108*a* and 110*a* and outer surfaces 104*b*, 106*b*, 108*b*, and 110*b* of respective sides 104, 106, 108 and 110.

It will be appreciated, therefore, that several blocks having the design of the block 20 may be stacked vertically, with the connection boss 116 of each block 20 disposed within and engaging the bottom 20*b* of another block 20. It will further be appreciated that that top 20*a* and the bottom 20*b* can compatibly connect with many commercially available traditional marble race toys that are not part of the kit 10. Thus, the blocks having the design of the block 20 may be combined with marble maze tracks of other manufacturers to combinations of marble mazes and marble model buildings. It will also be appreciated that the block 20 is formed of a single piece of injection molded plastic, which allows for ease of manufacturing in quantity.

Figure 3:
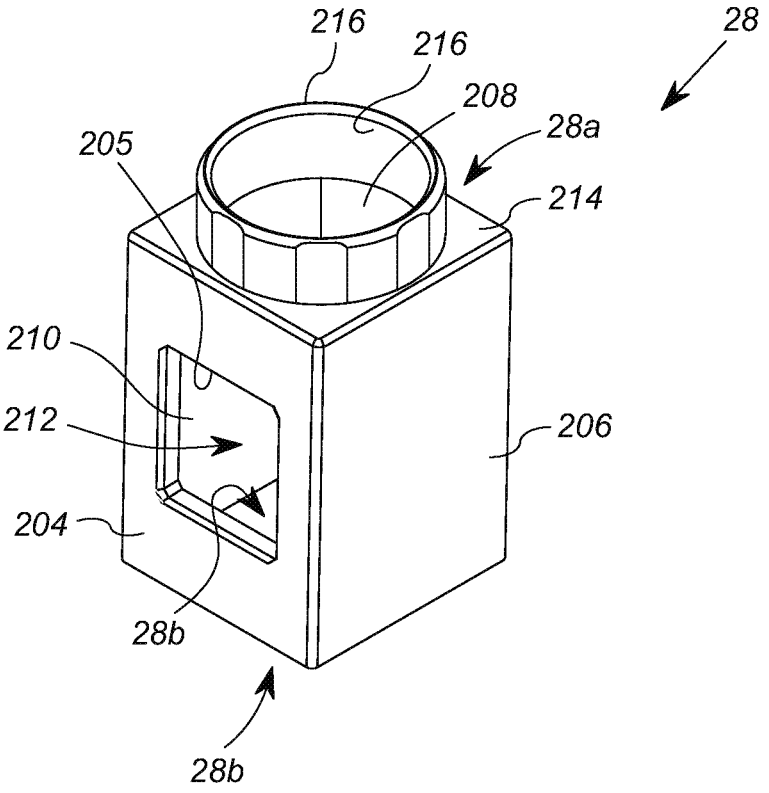
FIG. 3 illustrates a perspective view of another exemplary building block that may be included in or used in connection with the kit of FIG. 1.

FIG. 3 shows a perspective view of a second block 28. In addition to the top 28*a* and bottom 28*b*, the block 28 in this embodiment has first, second, third and fourth sides 204, 206, 208 and 210, respectively, that interconnected to form a tubular member 211 having an external perimeter defining a square cross-section and having an interior 212. The sides 204, 206, 208 and 210 are identical structure and configuration as the sides 104, 106, 108 and 110 of the first block 20 of FIGS. 2A-2C, with the exception that a first side 204 of the block 28 has an opening 205 sized to receive a toy marble therethrough. In this embodiment, the opening 205 is square or rectangular, but may take other shapes as long as it defines an opening for receiving a standard toy marble therethrough, for example, having a radial clearance of 8 mm to 10 mm.

The top 28*a* is substantially identical in structure and configuration to the top 20*a* of FIGS. 2A-2C. Thus, the top has a base portion 214 that engages (i.e. touches) the upper edge of each of the first, second, third and fourth sides 204, 206, 208 and 210, and a connection boss 216 extending upward from the base portion 214. The base portion 214 and connection boss 216 define a central opening 218 sized to receive a toy marble therethrough. The connection boss 216 may suitably be identical instruction to the connection boss 116 of FIGS. 2A, 2B and 2C.

The block 28 is in everyway identical to the block 20 except for the opening 205. The additional opening in the block 28 allows the tubular member 211 to receive a marble either through the central opening 218, or the first side opening 205, and guide the marble to the open bottom 28*b*. It is evident that several blocks having the design of blocks 20 and 28 may be connected to each other vertically, and that a marble would pass vertically from through all of the blocks. Referring to FIG. 1, it will further be appreciated that multiple stacks of the blocks 20, 28 may be built upward from and coupled to the pedestals 32 on the base platform 12.

Like the block 20, the block 28 is formed of a single piece of injection molded plastic. As will be discussed below, the design of block 28 can also be used as a block base for the block 22, which contains an additional piece.

Figure 4B:
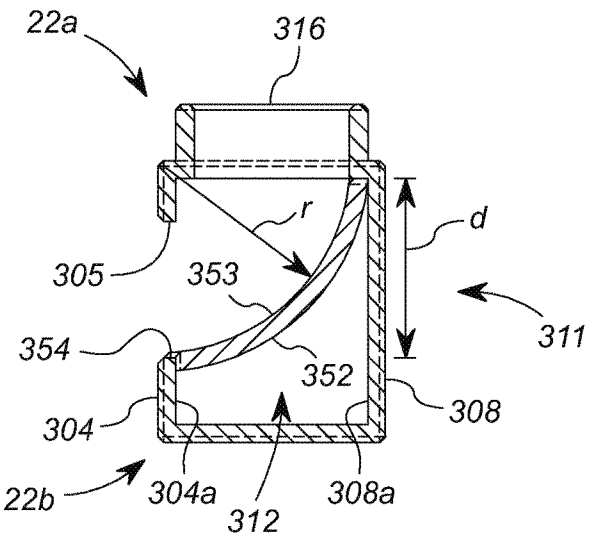
FIG. 4B illustrated a side cutaway view of the building block of FIG. 4A.
Figure 4A:
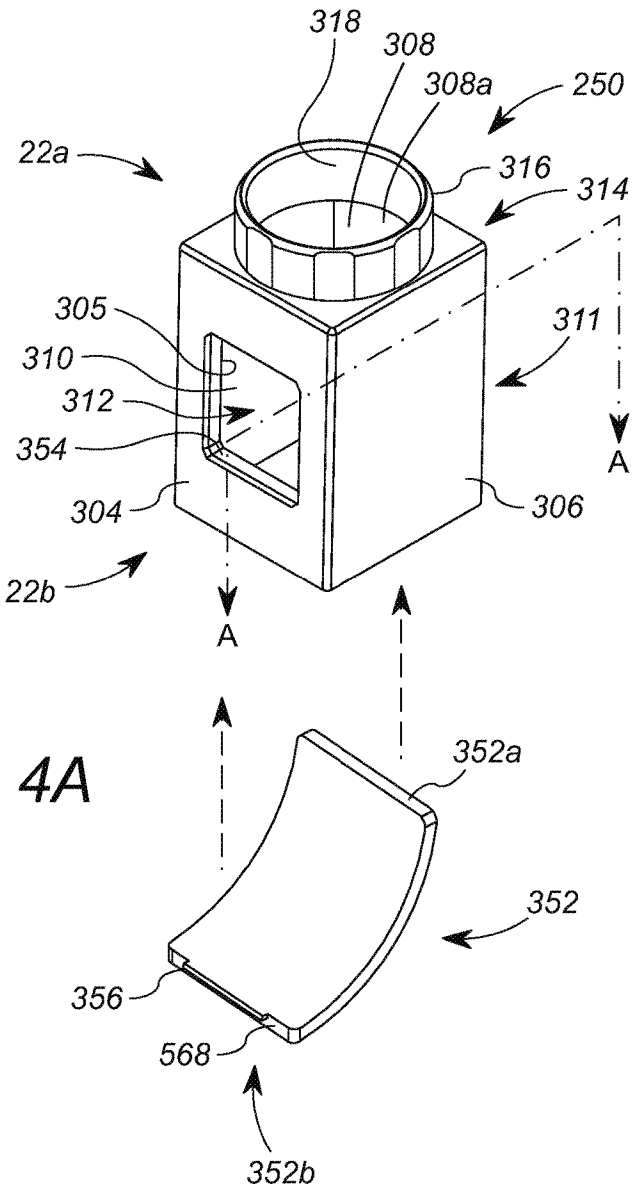
FIG. 4A illustrates an exploded perspective view of another exemplary building block that may be included in or used in connection with the kit of FIG. 1.

FIGS. 4A and 4B show another block 22 of the kit 10 of FIG. 1. FIG. 4A shows an exploded perspective view of the block 22, and FIG. 4B shows a side cutaway view of the block 22. The block 22 comprises a block base 250 that is identical in structure as the block 28 of FIG. 3, and a curved element curved element 352. The block base 250 includes the top 22*a* and bottom 22*b*, and first, second, third and fourth sides 304, 306, 308 and 310, respectively, that are identical in structure to the top 28*a*, bottom 28*b* and sides 204, 206, 208 and 210 of the block 28 of FIG. 3. The sides 304, 306, 308, and 310 form a tubular member 311 having an external perimeter defining a square cross-section and having an interior 312. The first side 304 includes a side opening 305 identical to the opening 205 of FIG. 3. Like the block 28, the block base 250 is formed from a single piece of injection molded plastic, and is configured to connect and stack with other blocks 20, 24, 26 and 28, as well as the pedestals 32. To this end, the top 22*a* of the block base includes a base portion 314 and connection boss 316 identical to the base portion 214 and connection boss 216 of FIG. 3, and defining a central opening 318 sized to receive a toy marble therethrough.

The curved element 352 is affixed to the block base 250 within the interior 312. The curved element 352 defines a curved, convex marble path or ramp from the top central opening 318 to the opening 305. Thus, the curved element 352 causes a marble entering through the top central opening 318 to exit through the side opening 305. It will be appreciated that when the block 22 is disposed adjacent to a block having the design of block 28 of FIG. 3, such that their respective side openings 205, 305 face each other, a marble entering the central opening 318 of the block 22 will be guided by the curved element 352 to the opening 305, pass into the interior 212 of the block 28 via the opening 205, and exit the block 28 through the open bottom 28*b*.

To this end, the curved element 352 extends in a curved manner from the top 22*a* adjacent the third side 308 to a bottom 354 of the opening 352 on the first side 304. The curved element 352 has a flat cross-section in the direction orthogonal to the marble path, but may in other embodiments have a different cross section.

The curved element 352 includes a first end 352*a* that abuts the top 22*a*, and specifically, the base portion 314. The curved element 352 has a second end 352*b* that engages a bottom ledge 354 of the opening 352. Along the marble path, the curved element 352 defines a concave inner surface 353 on which the marble is intended to travel. The inner surface 353 has a first curve radius r that is substantially equal to a linear vertical distance d from an interior surface of the base portion 314 to the bottom ledge 354. To engage and hold the second end 352*b* to the bottom ledge 354, the second end 352*b* includes vertical edge surface 358, and a lip portion 356 that extends the upper portion of the vertical edge surface 358. The vertical edge surface 358 engages an interior surface 304*a* of the first side 304 below the first opening 305, and the lip portion 356 extends into the opening 305. The curved portion 352 is thus held in place by a trap fit between the first end 352*a*, which is trapped between and against the bottom wall of the base portion 314 and the top of the interior surface 308*a* of the third side, and the second end 352, which is trapped by the lip portion 356 and vertical edge surface 358 engaging the bottom ledge 354. The curved portion 352 may also be optionally glued, if possible disassembly by the consumer is not desired.

Figure 5:
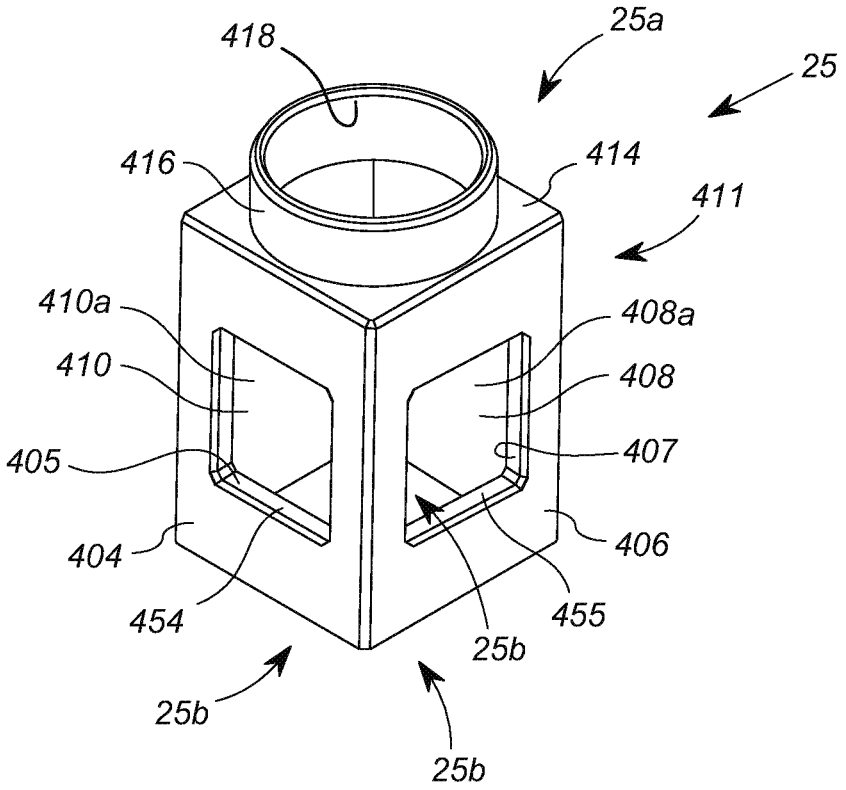
FIG. 5 illustrates a perspective view of yet another exemplary building block that may be included in or used in connection with the kit of FIG. 1.

FIG. 5 shows a perspective view of another embodiment of a block 25, which is not shown separate in FIG. 1, but which is shown as part of the block 24 of FIG. 1. The block 25 includes a top 25*a*, a bottom 25*b*, and first, second, third and fourth sides 404, 406, 408 and 410, respectively, that interconnected to form a tubular member 411 having an external perimeter defining a square cross-section and having an interior 412. The sides 404, 406, 408 and 410 are identical structure and configuration as the sides 204, 206, 208 and 210 of the block 28 of FIG. 3, with the exception that the second side 406 also includes an opening 407 that is identical to the opening 405 of the side 404. Thus, the block 25 has openings 405, 407 on adjacent sides, each of which are sized to receive a toy marble therethrough.

The top 25*a* is substantially identical in structure and configuration to the top 20*a* of FIG. 2. Thus, the top has a base portion 414 that engages each of the first, second, third and fourth sides 404, 406, 408 and 410, and a connection boss 416 extending upward from the base portion 414. The base portion 414 and connection boss 416 define a central opening 418 sized to receive a toy marble therethrough.

The block 25 is in every way identical to the block 28 except for the second side opening 407. The additional opening 407 in the block 25 allows the tubular member 411 to receive a marble either any of the central opening 418, the first side opening 405, or the second side opening 407, thus expanding the connection options. For example, using the various combinations of blocks having the design of block 22 and blocks 20 or 28, three different marble paths may converge at the block 25 via the two openings 405, 407 and the top central opening 418. The block 25 in any event guides the marble to the open bottom 25*b*.

Like the block 28, the block 25 is formed of a single piece of injection molded plastic. As will be discussed below, the design of block 25 can also be used as a block base for the block 24, which contains additional pieces.

Figure 6A:
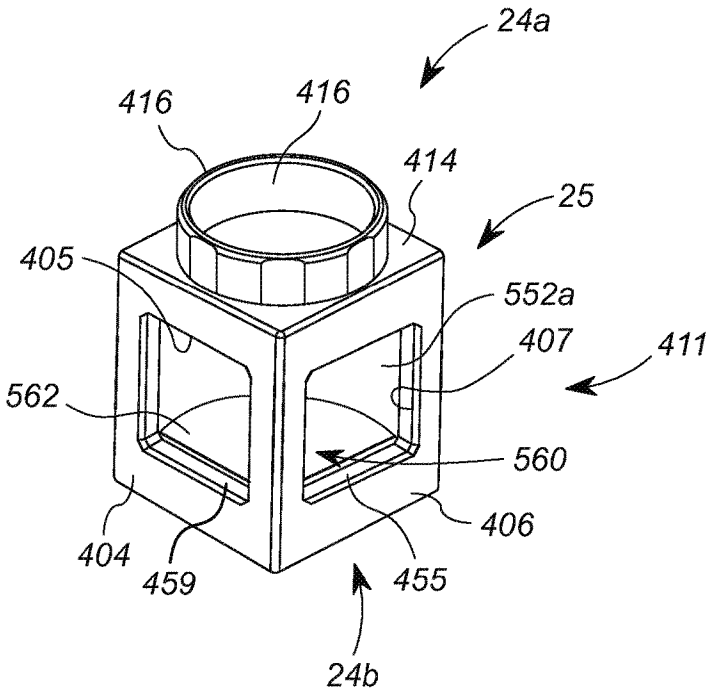
FIG. 6A illustrates a perspective view of yet another example building block that may be included in or used in connection with the kit of FIG. 1.
Figure 6B:
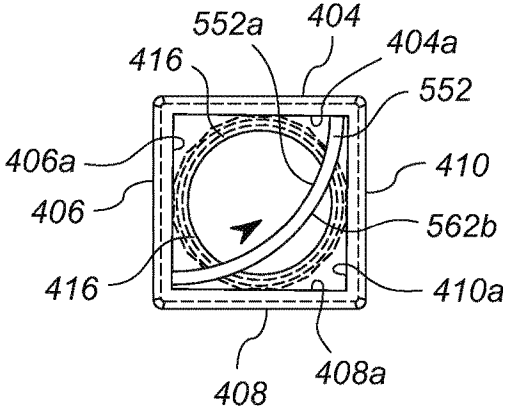
FIG. 6B illustrates a bottom plan view of the building block of FIG. 6A with a bottom element removed.
Figure 6C:
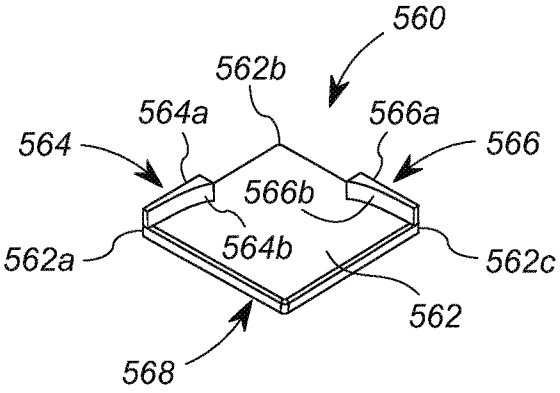
FIG. 6C illustrates a perspective view of the bottom element of the building block of FIG. 6A.

FIGS. 6A-6C show a block 24 which includes a block base having the design of the block 25, a second curved element 552, and a bottom element 560. In the description of FIG. 6, the block base will be referenced as block base 25, and the same reference numbers from FIG. 5 shall be used to describe the same structures of the block base 25. However, for clarity of exposition, the top 25*a* and bottom 25*b* of the block base 25 are referred to as top 24*a* and bottom 24*b*, to be consistent with the description of FIG. 1. FIG. 6A shows a perspective view of the block 24, FIG. 6B shows a bottom plan view of the block without the bottom element 560, and FIG. 6C shows a perspective view of the bottom element 560 alone.

The second curved element 552 extends in a curved manner from the first side 404 adjacent to the first opening 405 (and the fourth side 410, not visible in FIG. 5) to the second side 406 adjacent to the second opening 407 (and the third side 408, not visible in FIG. 5). The second curved element 552 has a flat cross-section in the direction orthogonal to the marble path, but may in other embodiments have a different cross section. It will be noted that in the case of the block 24, the marble path is intended to extend between the first side opening 405 and the second side opening 407, along a concave surface 552*a* of the second curved element. The second curved element 552 includes a convex (outer) surface 552*b* has a radius of curvature throughout that is less than a horizontal width of the first wall 404, to ensure proper marble guidance between the openings 405 and 407.

The second curved element 552 has a height that extends from the base portion 414 of the top 24*a* to the bottom 454 of the first opening 405, and to the bottom 455 of the second opening 407.

With reference to FIG. 6C specifically, the bottom element 560 includes a square plate 562 and first and second support ribs 564, 566, respectively. The square plate 562 is dimensioned to fit snugly within, and to engage, the interior surfaces 404*a*, 406*a*, 408*a*, and 410*a* of the respective sides 404, 406, 408 and 410 of the block base 25 (see also FIG. 5B). The first support rib 564 extends above and along an edge of the square plate 562 from a first corner 562*a* to about halfway to an adjacent second corner 562*b*. The first support rib 564 has a straight long side 564*a* abutting the interior surface 410*a* of the fourth wall 410 and a curved long side 564*b* abutting the convex (outer) surface 552*b* of the curved element 552. The curved long side 564*b* and the outer surface 552 have the same radius of curvature. The second support rib 566 extends above and along an edge of the square plate 562 from a third corner 562*c* (opposite first corner 562*a*) to about halfway to the second corner 562*b*. Analogous to the first support rib 564, the second support rib 566 has a straight long side 566*a* abutting the interior surface 408*a* of the third wall 408 and a curved long side 566*b* abutting the convex (outer) surface 552*b* of the second curved element 552, which has the same radius of curvature.

As shown in FIG. 6A, the bottom element 560 is disposed in the interior of the tubular member 411 such that the bottom of the second curved element 552 engages the plate 562. In such position the ribs 564 and 566 are trapped between the bottom of the second curved element 552 and the block base 25, thereby providing additional fit and support. The bottom surface 568 of the plate 562 is located at a distance from the bottom edges of the sides 404, 406, 408 and 410 that is substantially the same as, and slightly exceeding, the height of the connection boss 416. As such, the plate 562 does not interfere with the operation of the open bottom 24*b* to connect to the connection bosses of other blocks, or to connect to the pedestals 32.

The bottom element 560 may suitably be secured in place by an adhesive. The bottom element 560 cooperates with the base portion 514 of the top 24*a* to trap the second curved element 552 within the tubular structure 511. It will be appreciated that the top opening 418 is not used, but for ease of manufacturing may remain in the design of the block 24 when the block 25 is included within the kit 10.

Figure 7A:
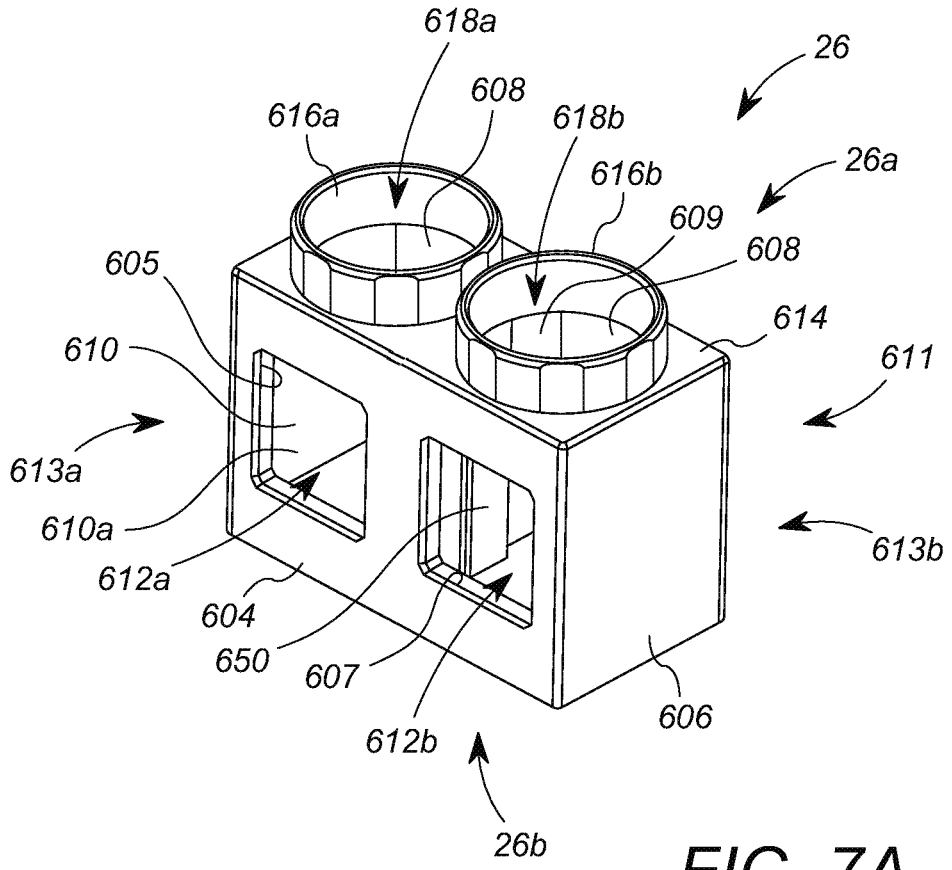
FIG. 7A illustrates a perspective view of another exemplary building block that may be included in or used in connection with the kit of FIG. 1.
Figure 7B:
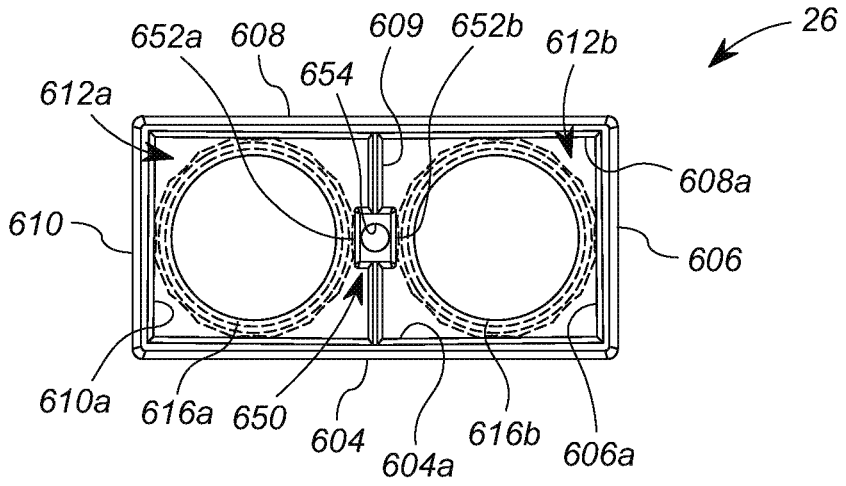
FIG. 7B illustrates a bottom plan view of the building block of FIG. 7A.

FIGS. 7A and 7B show another block 26 that is a functional equivalent of two adjacent blocks have the design of the block 28, and thus is also the functional equivalent of two adjacent block bases 250. FIG. 7A shows a perspective view of the block 26, and FIG. 7B shows a bottom plan view of the block 26.

In addition to the top 26*a* and bottom 26*b*, the block 26 in this embodiment has first, second, third and fourth sides 604, 606, 608 and 610, respectively, that interconnected to form a mostly hollow rectangular box 611. The sides 604 and 608 are twice as wide as the standard block sides 104, 204, 304, etc. of FIGS. 2 to 6. The side sides 606 and 610 have the same width as the standard block sides of FIGS. 2 to 6. The block 26 also includes an interior wall 609 that is aligned parallel to, and has substantially the same width as, each of the second and fourth sides 606 and 610, respectively. The interior wall 609 is extends between the midpoint of the first side 604 and the midpoint of the third side 608, such that the sides 604, 606, 608 and 610 and the interior wall 609 define two substantially identical interior spaces 612*a*, 612*b*, and form adjacent tubular members 613*a*, 613*b*.

The first side 604 of the block 26 has first and second openings 605, 607, respectively, each sized to receive a toy marble therethrough. In this embodiment, each opening 605, 607 is square or rectangular, but may take other shapes as long as it defines an opening for receiving a standard toy marble therethrough.

The top 26*a* has a base portion 614 that engages each of the first, second, third and fourth sides 604, 606, 608 and 610, and two connection bosses 616*a*, 616*b* that extend upward from the base portion 614. The base portion 614 and each connection boss 616 define respective top openings 618*a*, 618*b*, respectively, each sized to receive a toy marble therethrough. Each of the connection bosses 616*a*, 616*b* is identical in structure and function as the connection boss 116 of FIG. 2.

The block 26 is substantially identical in function as two laterally adjacent blocks 28. Accordingly, the open bottom 26*b* is configured to receive the connection bosses (e.g. 116, 216, 316 etc.) of two adjacent single blocks, such as blocks 20, 22, 24, 25 and 28. To this end, the interior wall 609 includes a pillar 650. The pillar 650 extends from the interior wall 609 into both the first interior 612*a* and 612*b*. Thus, the pillar 650 has a first interior surface 652*a* disposed within the first interior space 612*a*, and a second interior surface 652*b* disposed within the second interior space 612*b*.

The pillar 650 extends into the first interior 612*a* such that the distance d1 between the first interior surface 652*a* and the interior surface 610*a* of the fourth wall 610 is the same as the distance between opposing interior surfaces 604*a* and 604*b* of the respective first and third walls 604 and 608. Such distance is, in fact, the uniform distance between opposing interior surfaces of the walls of all of the blocks 20, 22, 24, 25 and 28. The first interior surface 652 of the first pillar 650 thus cooperates with the walls 604, 608 and 610 to form a friction fit to retain the connection boss (e.g. boss 116, 216 etc.) or a pedestal 32.

The pillar 650 similarly extends into the second interior 612*b* such that the distance between the second interior surface 652*b* and the interior surface 606*a* of the second wall 606 is the same distance, d1. Thus, the first pillar 650 thus cooperates with the walls 604, 606, and 608 to form a friction fit to retain the connection boss (e.g. boss 116, 216 etc.) or a pedestal 32. It will be appreciated that without the pillar 650, the interior wall 609 would need to be twice as thick as the other walls 604, 606, 608 and 610 to provide the same fitting function. However, doubling the thickness of the interior wall 609 unnecessary incurs undesirable material expense, cure time delay, and weight. In this embodiment, such disadvantages are avoided by the use of a thinner interior wall 609 and the pillar 650. In fact, the interior wall 609 may suitably be thinner than the walls 604, 606, 608 and 610.

While the pillar 650 extends the height of the block 26, in other embodiments, the pillar 650 may be replaced with any detent or rib that is only located at the bottom 26*b* where the connection to other blocks occurs. Such a detect or rib may have any suitable shape having a surface or edge that extends into the interior such that the distance from innermost surface of the rib or detect is the distance d1 from the inner surface 606*a* or 610*a*. Moreover, it will be appreciated that in yet other embodiments, the interior wall 609 may be located at the distance d1 from one of the interior surfaces 606*a*, 610*a*, and that the pillar, detent or rib would extend only in one direction, but twice as far, toward the other of the interior surfaces 606*a*, 610*a*.

Nevertheless, in the embodiment shown in FIGS. 7A and 7B, the fitting function of the detent or rib is formed as a continuous pillar 650. The use of a pillar 650 facilitates molding by avoiding overhang that would otherwise be present if a rib were only included at the bottom. As a further reduction in material and material thickness, the pillar 650 includes an interior channel or bore 654. The bore 654 may extend the entire height of the pillar 650, or a fraction thereof. The bore 654 in this embodiment is round in cross-section, but may be other shapes in other embodiments.

Like the blocks 20 and 28, the block 26 is formed of a single piece of injection molded plastic. It will further be appreciated that the curved element 352 of FIG. 4 may be inserted into either or both of the interiors 612*a*, 612*b* and snap fit into place with one of the windows 605, 607 in the same manner of block 22 of FIG. 4. Thus, the block 26 has further flexibility within the kit 10, particularly if at least some curved elements 352 are provided separately in the kit 10 of FIG. 1.

Figure 8A:
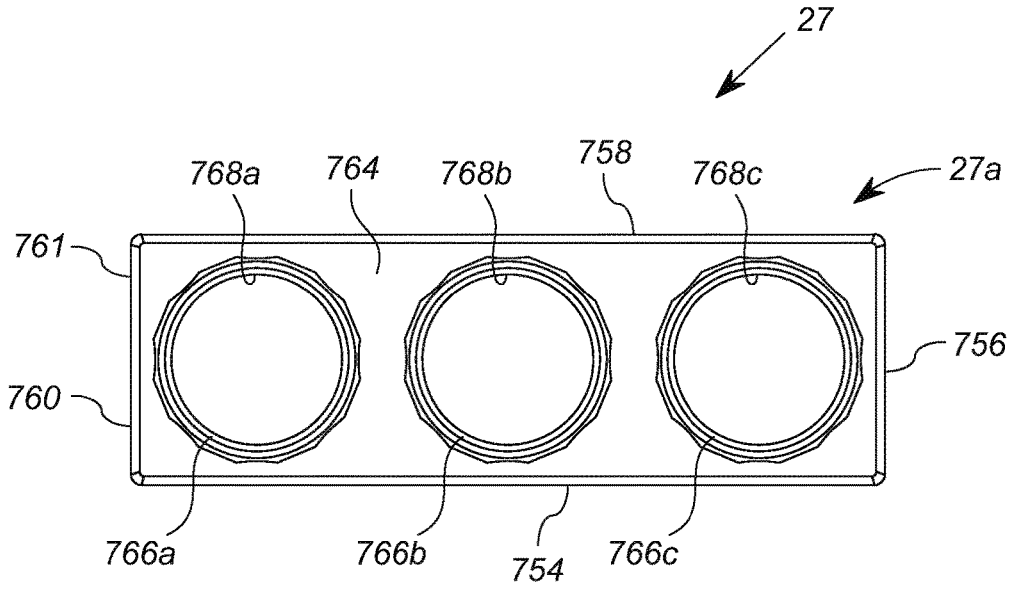
FIG. 8A illustrates a top plan view of another exemplary building block that may be included in or used in connection with the kit of FIG. 1.
Figure 8B:
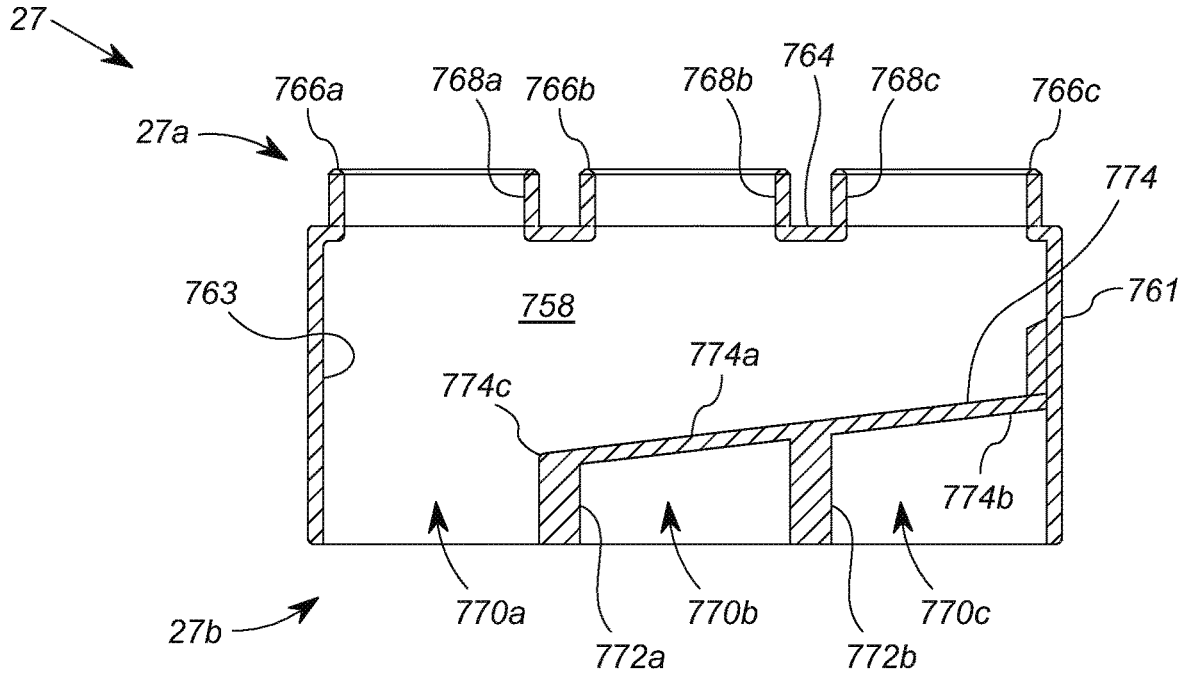
FIG. 8B illustrates a side cutaway view of the building block of FIG. 8A.

FIGS. 8A and 8B show another block 27 that may be included within the kit that has a footprint equivalent to three of the blocks 20, 22, 24 and 28, and includes an interior ramp 774 designed to direct a marble laterally within the block 27. FIG. 8A shows a top plan view of the block 27, and FIG. 8B shows a side cutaway view plan view of the block 27.

The block 27 includes a top 27*a*, a bottom 27*b*, and first, second, third and fourth sides 754, 756, 758 and 760, respectively, that interconnected to form a mostly hollow rectangular box 761. The sides 754 and 758 are three times as wide as the standard block sides 104, 204, 304, etc. of FIGS. 2 to 6. The side sides 756 and 760 have the same width as the standard block sides of FIGS. 2 to 6. The block 27 also includes an interior ramp 774 that extends through a portion of the interior 763 of the rectangular box 761.

The top 27*a* has a base portion 764 that engages each of the first, second, third and fourth sides 754, 756, 758 and 760, and three connection bosses 766*a*, 766*b* and 766*c* that extend upward from the base portion 764. The base portion 764 and each connection boss 766*a*, 766*b* and 766*c* define respective top openings 768*a*, 768*b*, and 768*c*, respectively, each sized to receive a toy marble therethrough. Each of the connection bosses 766*a*, 766*b* and 766*c* is identical in structure and function as the connection boss 116 of FIG. 2. The connection bosses 766*a*, 766*b* and 766*c* are spaced and arranged on the top such that they can receive three adjacent blocks having the design of the blocks 20, 22, 24 or 28, or one block 20, 22, 24 or 28 adjacent to block 26.

The open bottom 27*b* is configured to receive the connection bosses (e.g. 116, 216, 316 etc.) of three adjacent single blocks, such as blocks 20, 22, 24, 25 and 28 or one of such blocks in combination with the block 26. The open bottom 27*b* is divided into three adjacent sections 770*a*, 770*b*, and 770*c*, each disposed directly below and vertically aligned with a corresponding and respective top opening 768*a*, 768*b* and 768*c*. The open bottom sections 770*a*, 770*b* and 770*c* are separated by two intervening vertical wall segments 772*a*, 772*b*. Specifically, the vertical wall segment 772*a* separates the open bottom section 770*a* from bottom section 770*b*, and the vertical wall segment 772*b* separates the open bottom section 770*b* from bottom section 770*c*. Each of the open bottom sections 770*a*, 770*b* and 770*c* is sized to receive and couple (via friction fit) to a corresponding connection boss (e.g. 116, 216 etc.) of blocks of the kit 10.

The ramp 774 has a top surface 774*a* for transporting marbles and a bottom surface 774*b* and an internal end 774*c*. The ramp 774 may suitably be a flat, elongate plate, but may have any structure that provides a surface (or surfaces) suitable for transporting marbles. Thus, the ramp 774 and/or surfaces 774*a*, 774*b* may be concave, convex, or segmented in to lengthwise or widthwise sections.

The top surface 774*a* of the ramp 774 extends in a declined manner from the side wall 756 to the first vertical wall segment 772*a*, such that the internal end 774*c* intersects or contacts the first vertical wall segment 772*a*. The top surface 774*a* declines at an angle sufficient to ensure that, when bottom 27*b* the block 27 is disposed on a relatively horizontal surface, a standard marble will roll downward from any position thereon, off of the internal end 774*c*. Because the internal end 774*c* terminates at the first vertical wall segment 772*a*, any marble rolling off of the internal end 774*c* will fall down through the first open bottom section 770*a*. It will be appreciated that each of the vertical wall segments 772*a*, 772*b* extends from the bottom of the walls 754, 758 to the bottom of the lower surface 774*b* of the ramp 774.

It will also be appreciated that the top surface 774*a* of the ramp must be configured such that a standard marble may pass between the top surface 774*a* and the base portion 764. The bottom surface 774*b* must be configure such that the connection boss (e.g. 116, 216, etc.) of another block can be fully received and coupled within each of the open bottom sections 770*b*, 770*c*.

It can be seen that the block 27 allows for another variant of marble path segment. A marble may enter any of the top openings 768*a*, 768*b*, and 768*c* and exit through the first open bottom section 770*a*. It will also be appreciated that the same ramp design may be adapted to blocks having another block width, for example, such that there are four connection bosses and top openings, or to blocks having only a two-block width, similar to block 26. The maximum number of top openings is limited, however, by the competing factors of required angle of declination, the minimum height requirement between the top surface 774*a* and the base portions 764, and the minimum height requirement below the bottom surface 774*b* to allows for receipt of connection bosses in all parts of the open bottom 27*b*.

Figure 9A:
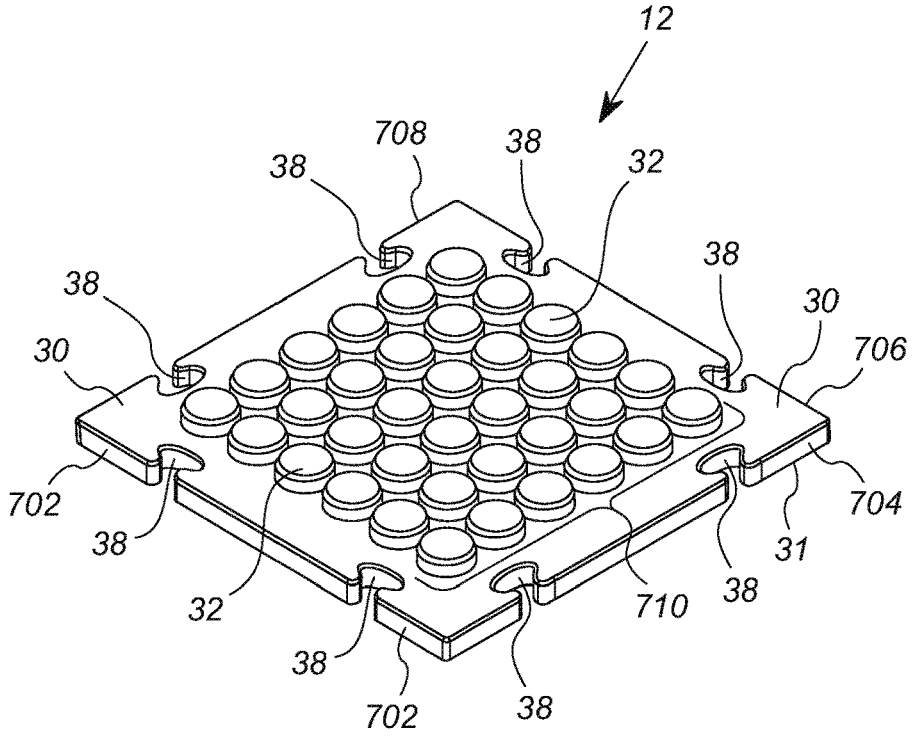
FIG. 9A illustrates a top perspective view of an exemplary base platform having pedestals for receiving blocks that may be included in or used in connection with the kit of FIG. 1.

FIG. 9A depicts a perspective view of a preferred embodiment of the base platform 12. The base platform 12 may be comprised of injection molded plastic, high density foam, rubber, or any other suitable platform material. As discussed above, the base platform 12 has a top surface 30, a bottom surface 31, and a plurality of pedestals 32 disposed on extending from the top surface 30. Each pedestal 32 is sized and configured to fit within the bottom 20*b*, 22*b*, 24*b*, 25*b*, 26*b* and 28*b* of corresponding blocks 20, 22, 24, 26 and 28, so as to engage and removable secure the blocks 20, 22, 24, 25, 26 and 28 to the corresponding base platform 12.

The first base platform 12 has four essentially straight sides (or edges) 702, 704, 706, and 708 that extend from the top surface 30 to the bottom surface 31. The sides 702, 704, 706 and 708 define the perimeter of the base platform 12. In this embodiment each of the sides 702, 704, 706 and 708 also include two receptacles 38. Each receptacle 38 is a recess in the otherwise straight side (e.g. side 702) that has a shape that is complementary to the plugs 36, not shown on FIG. 9A, but which would be part of adjoining base platforms of the plurality of base platforms 13. In this embodiment, the receptacle 38 has a uniform shape through the thickness of the base platform 12 from the top surface 30 to the bottom surface 31.

The pedestals 32 in this embodiment are arranged in a 6×6 array 710 of straight rows and straight columns. The array 710 of rows and columns allow for the blocks 20, 22, 24, 25, 26 and 28 to be combined to form, for example, models of buildings with planar walls several blocks wide However, it will be appreciated that other arrangements of pedestals 32 on the top surface 30 may be employed.

Figure 9B:
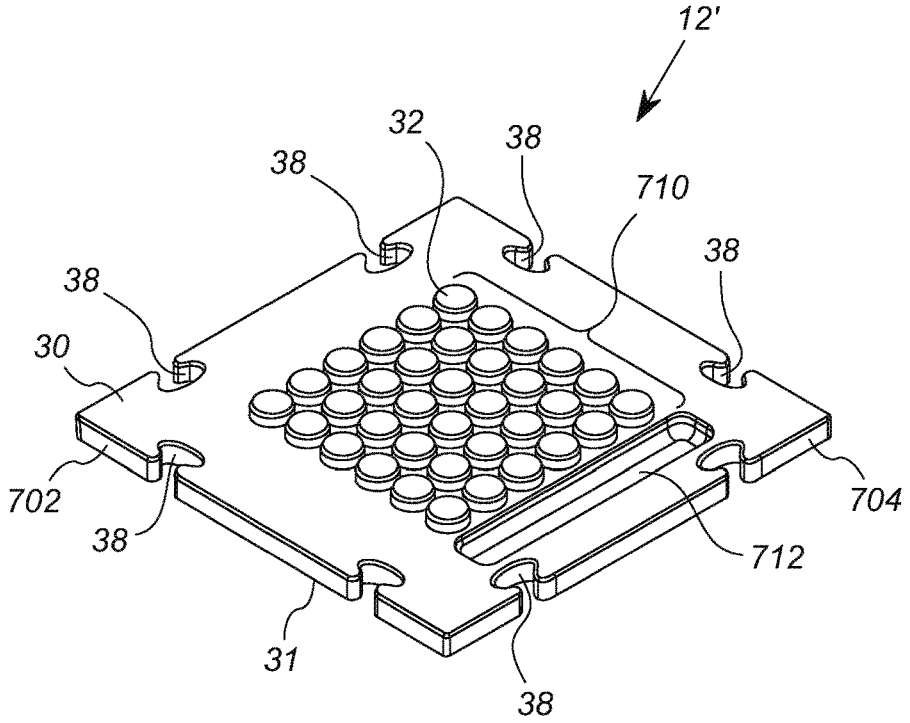
FIG. 9B illustrates a perspective view of another base platform having pedestals for receiving blocks that may be included in or used in connection with the kit of FIG. 1.

FIG. 9B depicts a perspective view of another preferred embodiment of a base platform 12' that may be included in the kit 10 of FIG. 1. The base platform 12' may suitably be identical to the first base platform 12 except for the addition of a depression 712 in the top surface 30 configured to receive at least one marble. In the embodiment described herein, the depression 712 is in the form of trough that extends adjacent multiple pedestals 32 between the array 710 and one of the sides 704 of the base platform 12'. With simultaneous reference to FIG. 4, it can be seen that when the block 22 is disposed on a pedestal 32 adjacent to the depression 712, within the window 305 facing in the direction of the depression 712, a marble entering the block 22 will exit the window 305 and fall into the depression 712, where it will be retained. It will be appreciated that the depression 712 may extend from the top surface 30 partially to, or all the way through, the bottom surface 31.

Figure 10:
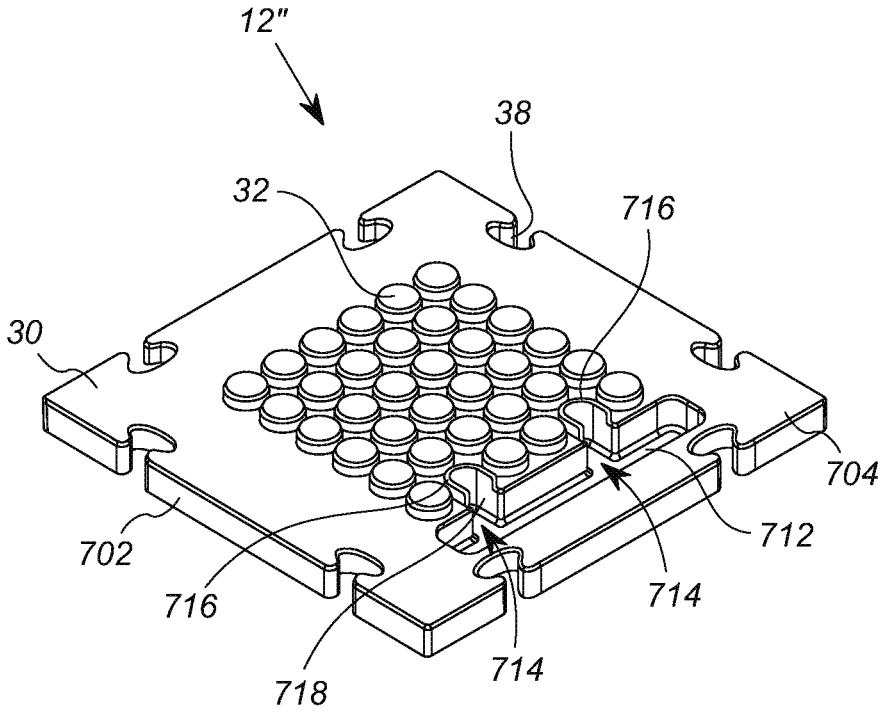
FIG. 10 illustrates a perspective view of yet another exemplary base platform having pedestals that may be included in or used in connection with the kit of FIG. 1.

FIG. 10 depicts a perspective view of yet another embodiment of a base platform 12" that may be included in the kit 10. The base platform 12" may suitably be identical to the first base platform 12' except for additional features that allow access to marbles that fall out of the bottoms 20*b*, 25*b*, 26*b* and 28*b* of blocks 20, 25, 26 and 28. In particular, one or more pedestals 32 in the array 710 is/are replaced with a marble catch 714 configured to receive a marble and guide the marble into the depression. Each of the marble catches 714 includes a C-shaped rim 716 designed to engage and fit within each of the bottoms 20*a*, 22*a*, 24*a*, 25*a* and so forth. A depression extension 718 is disposed under the C-shaped rim 716 and extends laterally to the depression 712, thereby providing a marble run from under the C-shaped rim 716 to the depression 712. Thus, marble structures may be built atop the base platform 12" with the final block 20, 25, 26, or 28 to be placed atop one of the marble catches 714, thus providing a marble path to easy user access in the depression 712.

Figure 11:
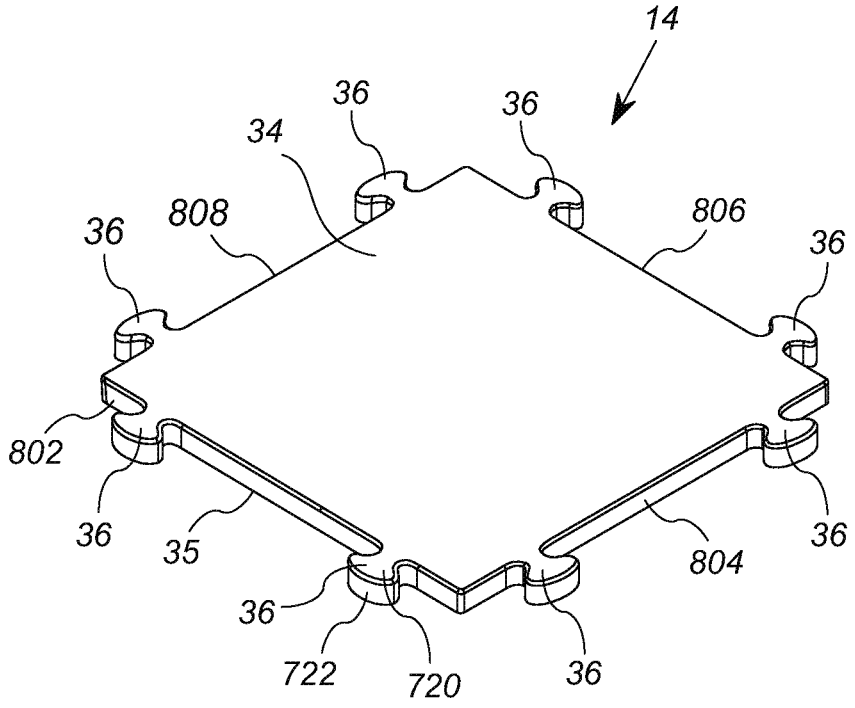
FIG. 11 illustrates a perspective view of an exemplary base platform without pedestals that may be included in or used in connection with the kit of FIG. 1.

FIG. 11 depicts an enlarged perspective view of the flat base platform 14 of FIG. 1. The second or flat base platform 14 has four essentially straight sides (or edges) 802, 804, 806, and 808 that extend from the top surface 34 to the bottom surface 35. The sides 802, 804, 806 and 808 define the perimeter of the base platform 14. In this embodiment, each of the sides 802, 804, 806 and 808 also include two plugs 36. Each plug 36 is a bulbous protrusion including a stem 720, and a bulb 722. The stem 720 extends laterally outward from the respective side/edge 802, 804, 806, or 808, and has a thickness or height identical to that of the rest of the base platform 14. The stem 720 terminates (seamlessly) in the side of the bulb 722. The bulb 722 is a rounded element having the same height as the rest of the base platform 14, and is wider than the stem 720. The bulb 722 and stem 720 are complementary in shape with respect to the receptacle 38.

FIG. 12 shows a perspective view of another embodiment of the flat base platform 14' that may be included within the kit 10 of FIG. 1. The flat base platform 14' is substantially identical to the base platform 14 of FIG. 11, with the exception that the flat base platform 14' has two sides 802, 806 with receptacles 38, and two sides with 804, 808 with plugs 36. Other base platforms having other combinations of plugs 36 and receptacles 38 may also be employed. However, it will be appreciated that the combination of base platforms 12, 12' and/or 12", having pedestals 32 and all receptacles 38, can be combined with base platforms having each of the designs of base platforms 14 and 14' to generate designs having continuous flat play surfaces (of the platforms 14 and 14') with intermixed pedestal surfaces (of the platforms 12, 12' and/or 12"). FIG. 13, for example shows an exemplary arrangement 850 of base platforms that includes a single flat base platform 14, four base platforms 14' and four base platforms 12'. The base platform 14 with four plugs is in the center of the arrangement. The four base platforms 14' are coupled to each side via the receptacles 38 on of the base platforms 14'. The four pedestaled base platforms 12' have receptacles 38 connected to plugs 36 from respective pairs of base platforms 14'. It will be appreciated that the plurality of blocks 11 may be built atop the platforms 12' to form building mazes, not shown, and the base platforms 14, 14' may still be used as a play surface for marbles, toy vehicles, toy animals, and the like.

It will be apparent to one skilled in the art that the platforms 12, 12', 12", 14 and 14' may be interchangeably assembled in a plurality of ways. Combinations of the plurality of blocks 11 may then be vertically built upon the base platform 12, 12' and/or 12" to make structures having marble paths therein. The possible designs can be practically infinite.

Figure 14:
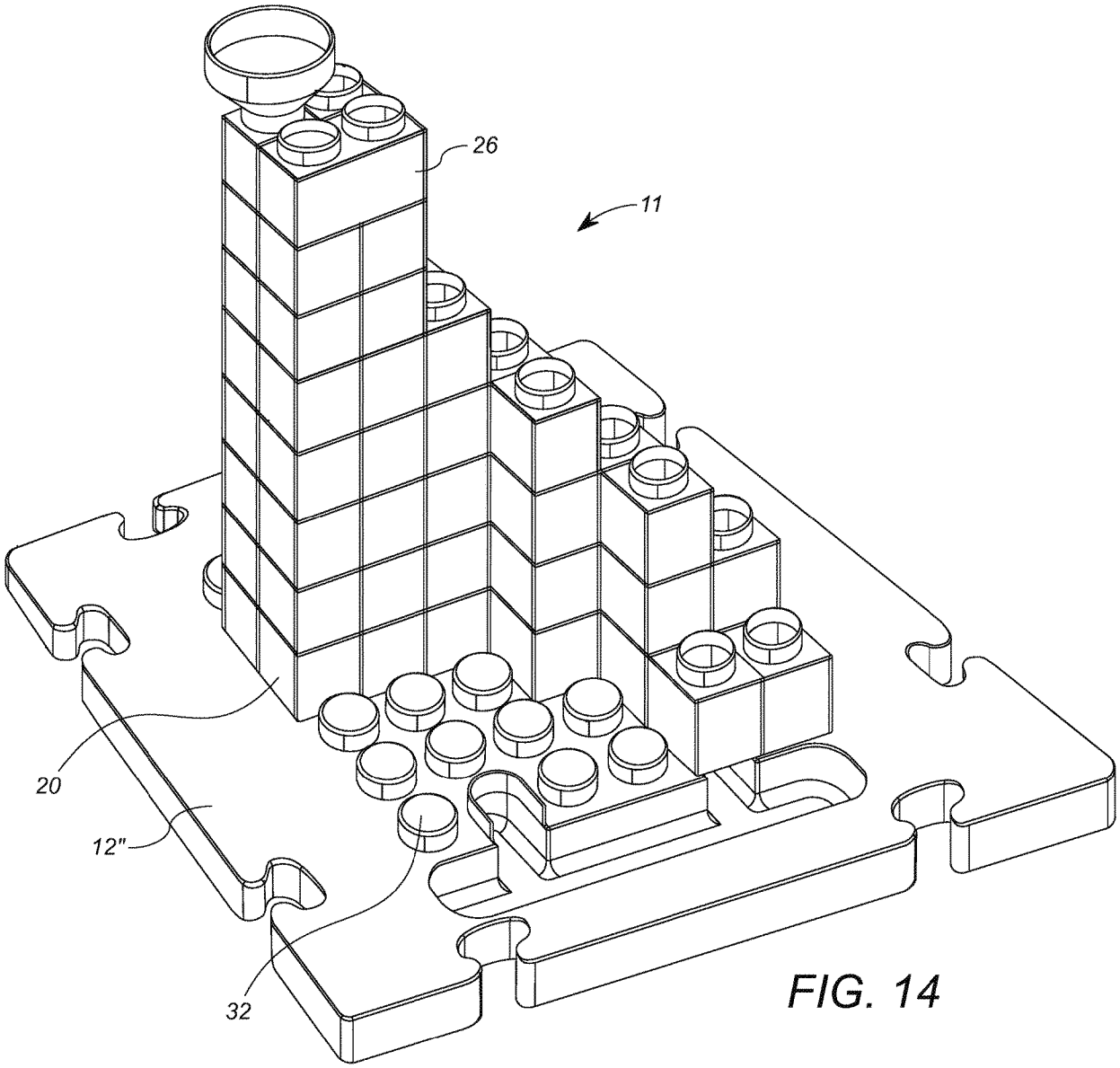
FIG. 14 shows a perspective view of an exemplary base platform with a plurality of different building blocks from the kit of FIG. 1 assembled thereon.

For purposes of illustration only, FIG. 14 shows a perspective view of an exemplary structure 5 that includes some of the plurality of the building blocks 11 assembled onto each other and onto an exemplary base platform 12". It can be seen that similar structures may be placed on each of the base platforms 12' of FIG. 13. At least some embodiments of the invention are kits that only include a single base platform (having pedestals 32) and the plurality of blocks 11. In a kit with a single base platform, the single base platform may or may not have mechanisms for interconnecting with other base platforms.

It will be appreciated that the above described embodiments are merely illustrative, and that those of ordinary skill in the art may readily devise their own modifications and implementations that incorporate the principles of the present invention and fall within the spirit and scope thereof.

What is claimed is:

1. A building block for a marble maze comprising a block base, the block base comprising:

first, second, third and fourth sides interconnected to form a tubular member having an external perimeter defining a square cross-section and having an interior, at least a first side having a first opening sized to receive a toy marble therethrough, a top side engaging each of the first, second, third and fourth sides, the top side having a base portion and a connection boss extending from the base portion, the connection boss and base portion having a second opening sized to receive a toy marble therethrough, wherein the first, second and third and fourth sides form an open-bottom opposite the top side;

a marble path element affixed to the block base, the marble path element disposed within the interior and defining a curved marble path, the marble path element including a first end that abuts the top side, and a second end that engages a bottom ledge of the first opening, wherein the second end includes a lip portion and a non-lip portion, and wherein the non-lip portion engages an interior of the first side below the first opening, and the lip portion extends into the first opening;

wherein the boss is configured to engage and fit within the first, second, third and fourth sides of a second block base having the same structure as the block base; and wherein the block base is formed of a single piece of plastic.

2. The building block of claim 1, wherein the curved marble path has a path center that extends in a direction from the first opening to the second opening, wherein a majority of the path center has an arcuate shape.

3. The building block of claim 2, wherein the marble path element extends from the top side adjacent to the third side to a bottom of the first opening of the first side, wherein the first side is opposite the third side.

4. A building block for a marble maze comprising a block base, the block base comprising:

first, second, third and fourth sides interconnected to form a tubular member having an external perimeter defining a square cross-section and having an interior, at least a first side having a first opening sized to receive a toy marble therethrough, a top side engaging each of the first, second, third and fourth sides, the top side having a base portion and a connection boss extending from the base portion, the connection boss and base portion having a second opening sized to receive a toy marble therethrough, wherein the first, second and third and fourth sides form an open-bottom opposite the top side;

a curved element affixed to the block base, the curved element disposed within the interior and defining a curved marble path having a path center that extends in a direction from one of the first and second opening to either the other of the first and second opening or to another opening in the block base, wherein a majority of the path center has an arcuate shape wherein the boss is configured to engage and fit within the first, second, third and fourth sides of a second block base having the same structure as the block base;

wherein the block base is formed of a single piece of plastic;

wherein the curved element extends from the top side adjacent to the third side to a bottom of the first opening of the first side, wherein the first side is opposite the third side; and wherein the curved element includes a first end that abuts the top side, and a second end that engages a bottom ledge of the first opening, and wherein the second end includes a lip portion and a non-lip portion, and wherein the non-lip portion engages an interior of the first side below the first opening, and the lip portion extends into the first opening.

5. The building block of claim 4, wherein the curved element has a concave inner surface, the inner surface having a first curve radius that is substantially equal to a linear vertical distance from an interior surface of the top side to the bottom ledge.

6. The building block of claim 4, wherein the curved element is configured to be inserted through the open bottom prior to being affixed.

7. The building block of claim 1, wherein the first side has a planar inner surface and a planar outer surface, and wherein first portions of the planar inner surface and the planar outer surface extend between the first opening and the open bottom.

8. The building block of claim 4, wherein the first side has a planar inner surface and a planar outer surface, and wherein first portions of the planar inner surface and the planar outer surface extend between the first opening and the open bottom.

9. The building block of claim 1, wherein the marble path element has a concave inner surface, the inner surface having a first curve radius that is substantially equal to a linear vertical distance from an interior surface of the top side to the bottom ledge.

10. The building block of claim 1, wherein the marble path element is configured to be inserted through the open bottom prior to being affixed.

11. The building block of claim 1, wherein the boss comprises a ring with discontinuities in an outer perimeter thereof.

12. The building block of claim 11, wherein the discontinuities are in the form of chords.

13. The building block of claim 4, wherein the boss comprises a ring with discontinuities in an outer perimeter thereof.

14. The building block of claim 13, wherein the discontinuities are in the form of chords.

* * * * *